United States Patent [19]

Chiba

[11] 4,078,525

[45] Mar. 14, 1978

[54] STEAM GENERATING DEVICE

[75] Inventor: Minoru Chiba, Tokyo, Japan

[73] Assignee: Ikeda Bussan Kaisah, Ltd., Tokyo, Japan

[21] Appl. No.: 729,898

[22] Filed: Oct. 6, 1976

[51] Int. Cl.[2] ..... F22B 27/00; D06F 75/06; F24H 3/04; H05B 1/00

[52] U.S. Cl. ..... 122/40; 38/77.83; 219/276; 428/464

[58] Field of Search ..... 428/457, 464, 624; 219/271, 272, 273, 275, 276; 34/97; 122/40; 38/77.83

[56] References Cited

U.S. PATENT DOCUMENTS

| | | | |
|---|---|---|---|
| 2,683,320 | 7/1954 | Morton | 122/40 |
| 3,499,237 | 3/1970 | Piper | 38/77.83 |
| 3,694,942 | 10/1972 | Vondracek | 38/77.83 |
| 3,781,519 | 12/1973 | Martin et al. | 219/276 |
| 3,947,659 | 3/1976 | Ono | 34/97 |

*Primary Examiner*—Kenneth W. Sprague
*Attorney, Agent, or Firm*—James E. Nilles

[57] ABSTRACT

A steam generating device comprising a metallic evaporation body of desired shape, such as a dish-like shape, a cylindrical shape and so on; and a thin layer provided on the surface of the body, the layer having a rough surface and a water absorption ability. In use, the device is heated and, then, a little water is intermittently supplied on the thin layer, so that the water is instantaneously evaporated.

6 Claims, 4 Drawing Figures

STEAM GENERATING DEVICE

BACKGROUND OF THE INVENTION

This invention relates to a device for instantaneously generating steam; in particular, to a steam generating device adaptable to be associated with a compact device such as a hair dryer of handhold type which supplies hot air for arrangement of hair.

For example, when a person arranges his dry hair with a hair dryer of handhold type, it is desirable to provide moisture to the hair by blowing steam against the hair before arranging his hair with the hair dryer. Therefore, it is desirable that the hair dryer be provided with a device for generating steam. Such device must be safe and compact and be able to instantaneously generate steam.

There is a well known device for generating steam such as in an electric steam iron. This device is of boiler type in which water is received in a container and heated to boiling by a heater so as to produce steam. Thus, in use, such device can not be inclined beyond a certain angle; otherwise, there is a danger that hot water will flow out from the container through the outlet for steam. Further in such device should the container be small there is a danger that boiling water will escape off through the outlet for steam regardless of the inclination of the device. Further, the device can not instantaneously generate steam and is required to have a large heater to heat the water. Thus, the boiler type device is not suitable for a compact device such as a hair dryer of handhold type.

There is another well known device for generating steam in which drops of water are intermittently supplied on a metallic vessel which is preheated and each drop is evaporated to generate steam. This device has the advantages that the device can be made in small size and it does not require a large size heater and can generate steam in a short time in comparison with the boiler type device described hereinbefore. However, with the evaporation of each drop of water there is considerable heat loss, so that the temperature of the surface of the vessel drops, and it becomes necessary to heat the surface a short time after each evaporation in order to insure continuous evaporation of the drops of water intermittently supplied on the surface. To accomplish the above, it is required to provide a potential (or inner) heat in the evaporation vessel to enable it to supply heat to the surface in a short time. It was found that when, for example, the average drop of water per evaporation is 0.5 cc, the vessel should have potential heat such that the temperature of the surface thereof becomes about 145° C to 160° C. However, when the surface is heated to such a temperature, the drop of water supplied on the surface is dispersed by the heat of the surface and each dispersed water is sphered, i.e., the so called heat shock phenomenon occurs, so that it becomes impossible to evaporate all of the water in a short time. Thus, the steam pressure becomes low so that the field of application thereof is limited; for example, it is not suitable to use it for providing moisture to hair by blowing steam against hair before arranging hair by means of a hair dryer.

SUMMARY OF THE INVENTION

Accordingly, it is an object of this invention to provide a steam generating device which can instantaneously and continuously generate steam.

Another object of this invention is to provide a compact device for generating steam so that the device can be associated with a compact device such as a hair dryer of handhold type.

A further object of this invention is to provide a steam generating device which can be safely used at any angle.

A steam generating device according to this invention comprises a metallic evaporation body of desired shape, such as a dish-like shape, a cylindrical shape and so on, and a thin layer provided on the surface of the body, the layer having a rough surface and a water absorption ability. The layer may be formed by, for example, coating a carbohydrate material on the surface of the evaporation body and, then, burning it into the surface. In use, the so formed device is heated and, then, a little water is intermittently supplied on the layer, so that the water is absorbed into the layer and instantaneously evaporated without occurrence of heat shock phenomenon as stated hereinbefore. In this device, even if the device is so heated that the temperature of the layer becomes about 150 C in order to continuously generate steam by intermittently supplying 0.5 cc of water with a short time interval, the heat shock phenomenon stated above does not occur and it makes it possible to safely and continuously generate steam.

The above and other objects and attendant advantages of the present invention will be more readily apparent to those skilled in the art from a reading of the following description when read in conjunction with the accompanying drawings which show preferred embodiments of the invention for illustration purpose only, but not for limiting the scope of the same in any way.

DESCRIPTION OF THE PREFERRED EMBODIMENTS

Figure 1:
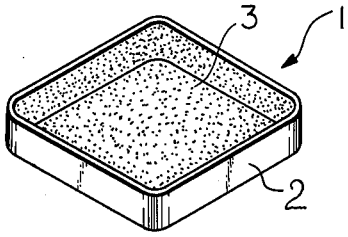
FIG. 1 is a perspective view of a steam generating device according to this invention.
Figure 2:
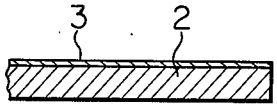
FIG. 2 is a cross sectional view of a portion of the device shown in FIG. 1 showing the relation of a evaporation body and a layer provided on the surface of the body.

Referring now to FIG. 1, a steam generating device 1 in accordance with this invention is shown.

The device 1 comprises a metallic evaporation body 2 made from metallic material such as brass in a dish-like shape and a thin layer 3 provided on the inner surface of the body 2, the layer having a rough surface and a water absorption ability, the heat conductivity of the layer being lower than that of the metallic material of the body. The layer 3 is typically made by coating a carbohydrate material such as sugar on the surface and burning it into the surface at about 300° C in a very short time. In use, the so formed device is so heated that the temperature of the layer 3 becomes more than 100° C and a little water is then supplied on the layer, so that the water is instantaneously evaporated without being widely spread and also being sphered by heat of the layer. Though, the temperature of the layer drops considerably due to evaporation heat loss, the layer is heated to the initial temperature by an inner (or potential) heat in the body 2 in a short time to enable it to effect the next evaporation. As stated hereinbefore it is found that when 0.5 cc of water is intermittently supplied to the device to continuously generate steam, it is desirable to heat the device so that the layer 3 becomes about 145° C – 160° C. Incidentally, it is apparent that the body 2 is not limited to the dish-like shape and may have other shapes such as a plate-like shape, a cylindrical shape and so on in accordance with necessity.

Figure 3:
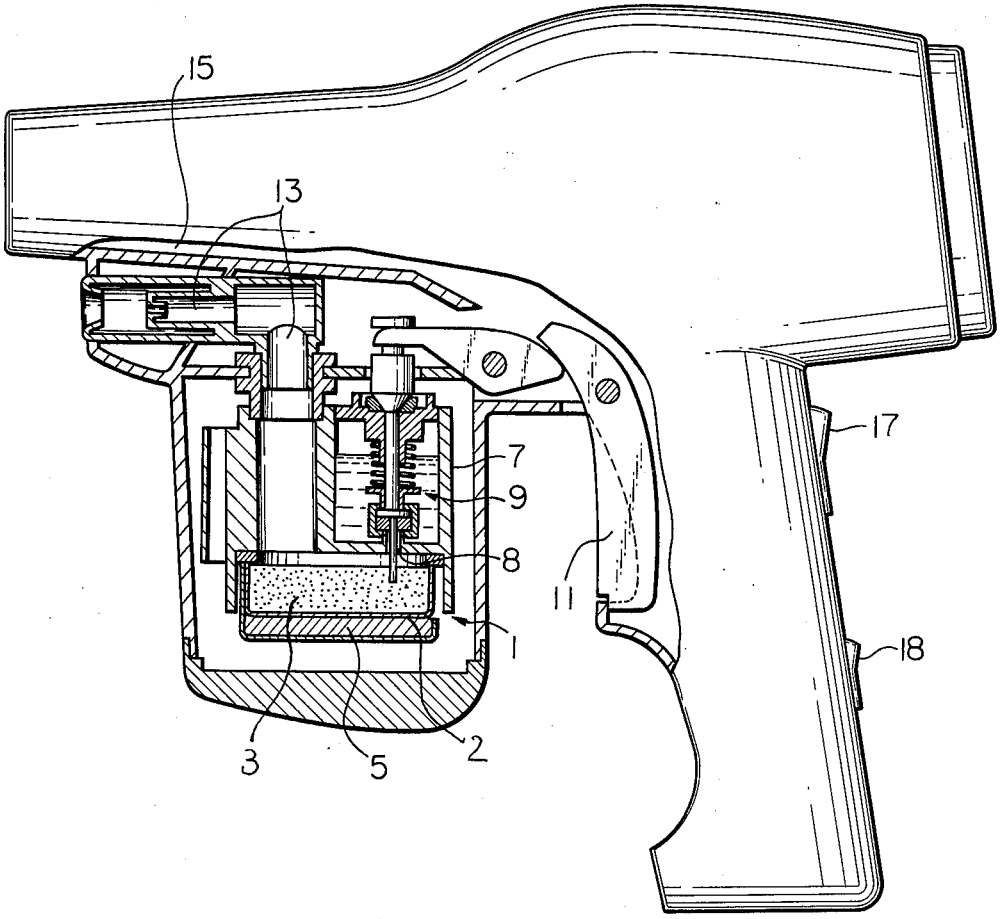
FIG. 3 is a partial sectional view of a handy hair dryer in which the device shown in FIG. 1 is associated.

Referring to FIG. 3, the steam generating device 1 is installed in a hair dryer of handhold type. As illustrated therein, the device 1 is associated with an electric heater 5 provided under the bottom thereof and a reservoir 7 which is positioned upwardly of the device 1. A valve means 9 for an outlet 8 in the bottom of the reservoir 7 is provided in the reservoir 7. The valve means 9 is operated by lever 11 to open the outlet 8 to drop a predetermined volume of water onto the layer 3. The reference 13 illustrates a passage for steam which is generally parallel to a passage 15 for hot air of the dryer at around the outlet thereof. The references 17 and 18 illustrate electric switches for the electric heater 5 and a device (not shown) for generating and blowing hot air of the dryer, respectively.

In operation, firstly the switch 18 is turned on to actuate the heater 5 to heat the body 2 and layer 3. Then, the lever 11 is pushed to supply a predetermined amount of water onto the layer 3, so that the water is instantaneously evaporated and the steam generated is outwardly emitted through the passage 13.

Figure 4:
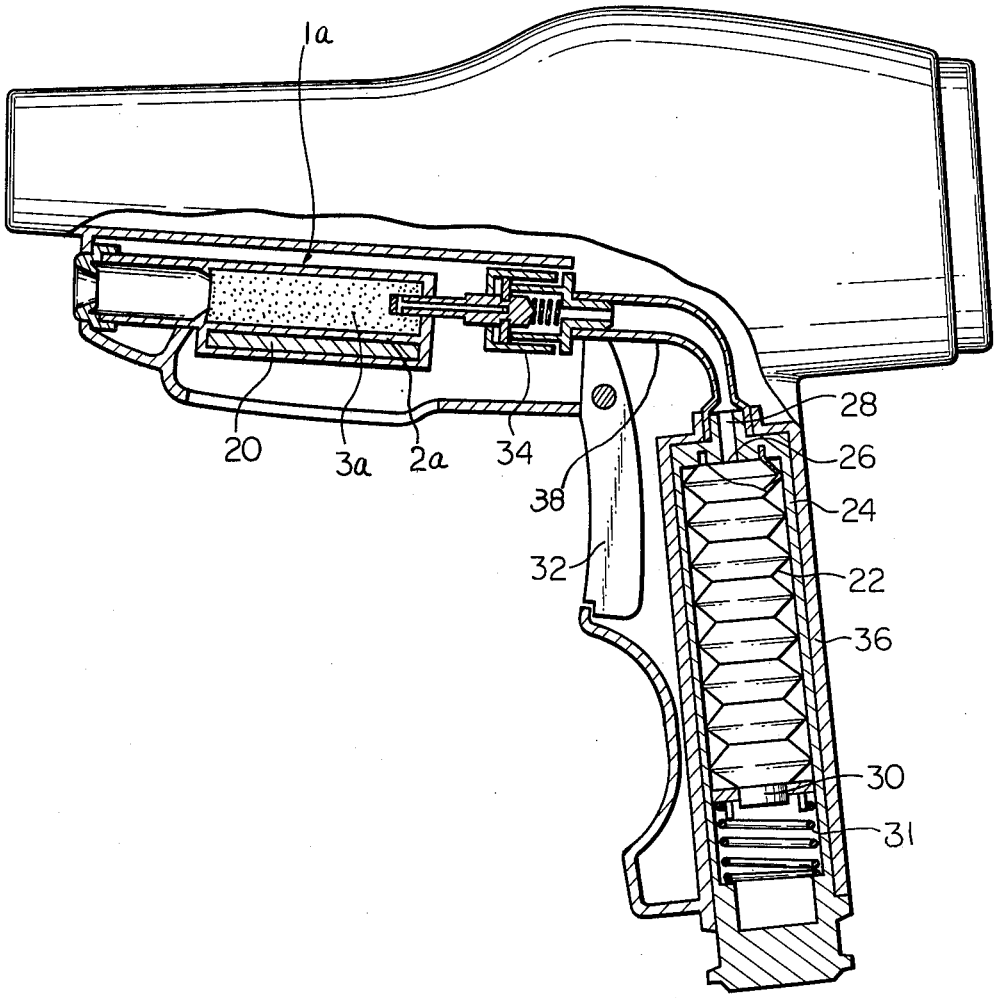
FIG. 4 is a partial sectional view of a handy hair dryer in which a heat generating device of another embodiment of this invention is installed.

Referring to FIG. 4, there is shown a steam generating device 1*a* of another embodiment of this invention which is installed in a hair dryer of handhold type. In this embodiment, the device 1*a* comprises a metallic evaporation body 2*a* of cylindrical shape and a layer 3*a* provided on the inner surface of the body 2*a* corresponding to the layer 3 shown in FIG. 1. The device 1*a* is associated with an electric heater 20 provided under the bottom of the body 2*a* and a water reservoir 22 received in a grip portion 36 of the hair dryer, the reservoir being made from flexible material in a bellows-like shape. The reservoir 22 is received in a generally cylindrical member 24 so that the reservoir 22 is installed in the grip portion 36 by inserting the cylindrical member 24 into a hole provided in the grip portion. The open end 26 of the reservoir 22 is connected to the device 1*a* through a passage 38 and valve 34. In the cylindrical member 24, a compressed spring 31 is received to urge the closed end 30 of the reservoir 22 towards the open end 26 whereby when a lever 32 is pushed so as to open the valve means 34 the water received in the reservoir 22 is supplied in the device 1*a* regardless of the inclination of the hair dryer. The cylindrical member 24 is releasably installed in the grip portion 36 of the hair dryer by latch means (not shown).

Having thus described the construction and operation of the preferred embodiments of the invention, various modifications within the spirit of the invention will become apparent to those skilled in the art and can be made without departing from the underlying principles of the invention as defined in the claims.

What is claimed is:

1. A device for generating steam comprising;

a metallic evaporation body of desired shape; and a thin layer provided on the surface of said body, the layer comprising a carbohydrate material, said material being coated on said surface and burned into the surface.

2. A device as set forth in claim 1 further including heater means for heating said body and layer; and means for intermittently supplying a little water to said layer.

3. A device as set forth in claim 2 in which said water supplying means includes a water reservoir; and a normally closed passage which is adapted to introduce the water in said reservoir onto said layer, the water in said reservoir being pressurized whereby upon opening said passage the water is supplied onto said layer through said passage regardless of the inclination of said steam generating device.

4. A device as set forth in claim 3 in which said water supplying means is adapted to intermittently supply about 0.5 cc of water per one time and said heater means is adapted to heat said body so that said layer provided thereon becomes about 145° C – 160° C.

5. A device as set forth in claim 3 in which said means for supplying water is made from flexible material and is compressed by compression means so that the water in the reservoir is pressurized.

6. A device as set forth in claim 5 in which said compression means is a compressed spring.

* * * * *